US006575078B1

(12) United States Patent
Wright et al.

(10) Patent No.: US 6,575,078 B1
(45) Date of Patent: Jun. 10, 2003

(54) FLUID MOTOR HAVING FLUID ACTUATED ADVANCING ELEMENTS TO ADVANCE AN ADVANCEABLE PART OF THE FLUID MOTOR RELATIVE TO A STATOR PART OF THE FLUID MOTOR

(75) Inventors: Lyndon J. Wright, Huntington Cambs (GB); Micheal Hibbert, Bucks (GB)

(73) Assignee: Motorvation International Limited, Wembley (GB)

( * ) Notice: Subject to any disclaimer, the term of this patent is extended or adjusted under 35 U.S.C. 154(b) by 0 days.

(21) Appl. No.: 09/744,867

(22) PCT Filed: Jul. 26, 1999

(86) PCT No.: PCT/GB99/02443

§ 371 (c)(1),
(2), (4) Date: Feb. 20, 2001

(87) PCT Pub. No.: WO00/06869

PCT Pub. Date: Feb. 10, 2000

(30) Foreign Application Priority Data

Jul. 30, 1998 (GB) ..... 9816675

(51) Int. Cl.[7] ..... F01B 13/04

(52) U.S. Cl. ..... 91/491; 417/491; 417/492; 417/499; 417/500; 417/502

(58) Field of Search ..... 417/476, 479, 417/481, 491, 492, 499, 500, 502; 91/491

(56) References Cited

U.S. PATENT DOCUMENTS

| | | | | |
|---|---|---|---|---|
| 3,511,131 A | * | 5/1970 | Kress | 417/491 |
| 4,624,174 A | | 11/1986 | Eickmann | 91/485 |
| 6,099,273 A | * | 8/2000 | Allart et al. | 180/308 |

FOREIGN PATENT DOCUMENTS

| | | |
|---|---|---|
| EP | 0069462 A2 | 1/1983 |
| GB | 1058941 | 2/1967 |
| GB | 1242381 | 8/1971 |
| GB | 0069462 A2 * | 2/1982 |
| GB | 2109056 A | 5/1983 |

* cited by examiner

*Primary Examiner*—Charles G. Freay
*Assistant Examiner*—Emmanuel Sayoc
(74) *Attorney, Agent, or Firm*—Price, Heneveld, Cooper, DeWitt & Litton

(57) ABSTRACT

A fluid motor includes a plurality of fluid actuated pistons 13 extending radially outwards from a stator and each having a cam follower bearing 14 at its outer end. A rotor surrounds the stator and includes an inwardly facing drive cam profile engaged by the cam follower bearings 14 to advance the rotor relative to the stator. The drive cam profile 8 is substantially sinusoidal as a result of which substantially constant torque is achieved.

17 Claims, 6 Drawing Sheets

SECTION A-A

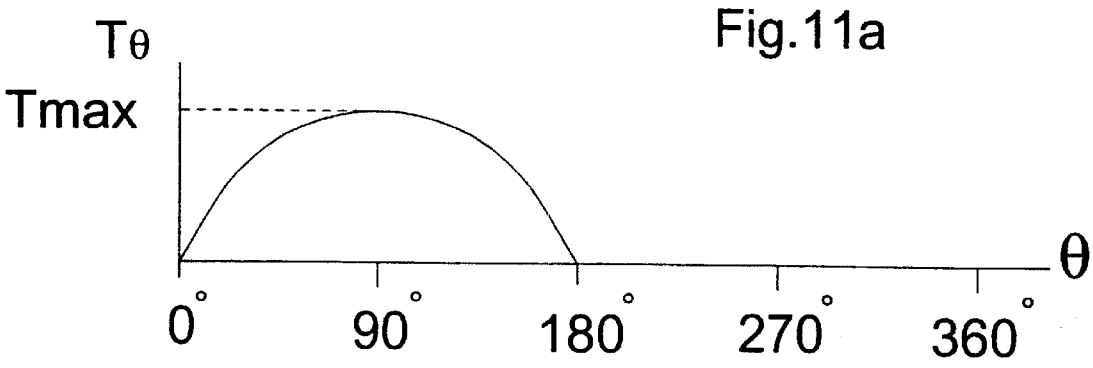
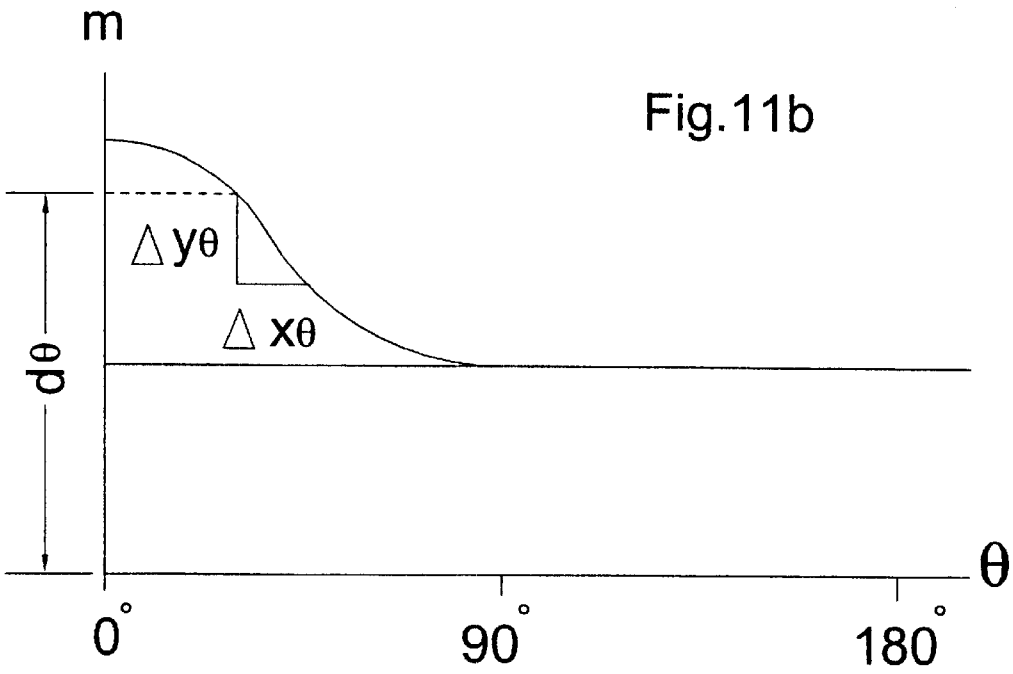
CAM PROFILE

FLUID MOTOR HAVING FLUID ACTUATED ADVANCING ELEMENTS TO ADVANCE AN ADVANCEABLE PART OF THE FLUID MOTOR RELATIVE TO A STATOR PART OF THE FLUID MOTOR

This application is the National Stage of International Application No. PCT/GB99/02443, filed Jul. 26, 1999, which claims priority to UK Patent Application No. 9816675.4, filed Jul. 30, 1998.

The invention relates to a fluid motor, in particular a fluid motor of the type having a plurality of fluid actuated advancing elements such as pistons cooperating with a drive cam profile to achieve linear or rotational movement.

Various fluid motors are known in the art. For example known air motors include a rotor incorporating an eccentric or lobed cam having a plurality of pistons provided on a stator around it. The pistons are driven by air in sequence such that the lobed cam is advanced by the pistons to give rise to rotation of the rotor.

GB 2109056 relates to a fluid motor in which a tri-lobed cam is mounted on a rotor with four pistons disposed symmetrically around it to drive it. The pistons also act as valves governing the supply and exhaust of drive fluid to other of the pistons.

A problem associated with known fluid motors is that variations in the output torque are unacceptably high.

According to the present invention there is provided a fluid motor comprising a stator part and an advancable part advancable relative to the stator part, in which one of said parts includes a drive cam profile and the other part includes one or more fluid actuated advancing elements arranged to traverse the drive cam profile to advance the advancable part relative to the stator part, in which the drive cam profile is substantially sinusoidal. As a result substantially constant torque is achievable.

Preferably a plurality of advancing elements are provided each arranged to advance the advancing part during an advancing stroke, at least some of the advancing strokes overlapping temporally. Preferably the full stroke of an advancing element is 360° of the full stroke, the advancing stroke comprising 180° of the full stroke and sequential advancing strokes of respective advancing elements overlap by 90°. Preferably the parts are rotationally advancable relative to one another and the drive cam profile comprises a linear substantially sinusoidal profile mapped onto a circular geometry. Preferably the advancing elements are mounted to oscillate on the stator part and the advancable part comprises a rotor part. Preferably the advancing elements are provided in synchronised opposing pairs on the stator part allowing radial or axial forces to be balanced.

Preferably the drive cam profile on the rotor part is disposed radially outside the stator part and the advancing elements oscillate in a radial direction; alternatively the drive cam profile on the rotor part may be disposed radially inside the stator part and advancing elements may oscillate in a radial direction; alternatively the drive cam profile on the rotor part may be disposed axially outside the stator part and the advancing elements may oscillate in an axial direction.

Alternatively the parts may be linearly advancable relative to one another and the advancing elements may oscillate in a direction transverse to the linear advancing direction.

Preferably the advancing elements comprise reciprocating pistons and either the number of pistons is a multiple of four and the number of lobes on the drive cam profile is a multiple of three or the number of pistons is a multiple of six and the number of lobes on the drive cam profile is a multiple of eight to achieve optimum torque from the pistons.

At least one actuable valve is preferably provided to control fluid actuation of the or each advancing element, a valve cam profile preferably being provided fixed relative to the drive cam profile, and the valve cam profile preferably cooperating with the valve to control actuation of the valve.

Alternatively at least one actuable valve is preferably provided to control fluid actuation of the or each advancing element, electronic control means being provided to control actuation of the valve.

Preferably the stator part and advancing part are symmetrically arranged allowing the motor to be stalled and/or operated in reverse. The advancing elements may comprise double acting pistons.

According to the invention there is further provided a fluid motor comprising a stator part and an advancable part advancable relative to the stator part, in which one of said parts includes a drive cam profile and the other part includes one or more fluid actuated advancing elements arranged to traverse the drive cam profile to advance the advancable part relative to the stator part, in which one or more valves is provided to control fluid actuation of the or each drive element, in which a valve cam profile is provided fixed relative to the drive cam profile, and in which the valve cam profile cooperates with the or each valve to control actuation of the valve. As a result direct synchronisation can be achieved without affecting the performance of the pistons directly.

The valve may include a cam follower valve actuation controller mechanically linked to the valve and arranged to follow the valve cam profile to control actuation of the valve; alternatively a valve cam profile follower may be arranged to generate a control signal representative of its position on the valve cam profile and the valve may be electronically actuated dependent on the control signal.

According to another aspect of the invention there is provided a fluid motor comprising a stator and a rotor in which the rotor includes a drive cam profile and the stator includes a fluid actuated advancing element arranged to oscillate in a radial direction to traverse the cam profile to advance the rotor relative to the stator, in which the drive cam profile on the rotor is disposed radially outside the stator. As a result the torque output is smoothed as the individual advancing element strokes each contribute only a small advancement of the rotor.

Preferably there is a rotor shaft around which the stator is provided, a drive cam profile support extending from the shaft and a valve cam profile provided on the drive cam profile support spaced from the drive cam profile in which at least one actuable valve is provided to control fluid actuation of the or each drive element and in which the valve cam profile cooperates with the valve to control actuation of the valve.

According to another aspect there is provided a fluid motor comprising a stator and a rotor, in which the rotor includes a drive cam profile and the stator includes a fluid actuated advancing element arranged to oscillate in the axial direction to traverse the drive cam profile to advance the rotor relative to the stator in which the drive cam profile is disposed axially outside the stator and includes first and second parts disposed axially outside opposing sides of the stator. As a result both axial and radial symmetry is achieved, allowing the forces to be balanced.

According to another aspect of the invention there is provided a fluid motor comprising a stator part and an advancable part advancable relative to the stator, in which one of said parts includes a drive cam profile and the other part includes a fluid actuated advancing element arranged to traverse the drive cam profile and advance the advancable part relative to the stator part, in which the parts are linearly drivable relative to one another.

According to another aspect there is provided a fluid motor comprising a stator part and an advancable part drivable relative to the stator part in which one of said parts includes a drive cam profile and the other part includes one or more fluid actuated advancing elements arranged to traverse the drive cam profile to advance the advancable part relative to the stator part, in which one or more valves is provided to control fluid actuation of the or each advancing element and actuation of the valve is controlled dependent on the relative position of the two parts.

The invention also comprises a valve actuator including a fluid motor of the type discussed herein.

Embodiments of the invention will now be described, by way of example, with reference to the drawings of which:

FIG. 2 is a view in the direction of the rotor axis showing the section AA on which FIG. 1 is taken;

Figure 2:
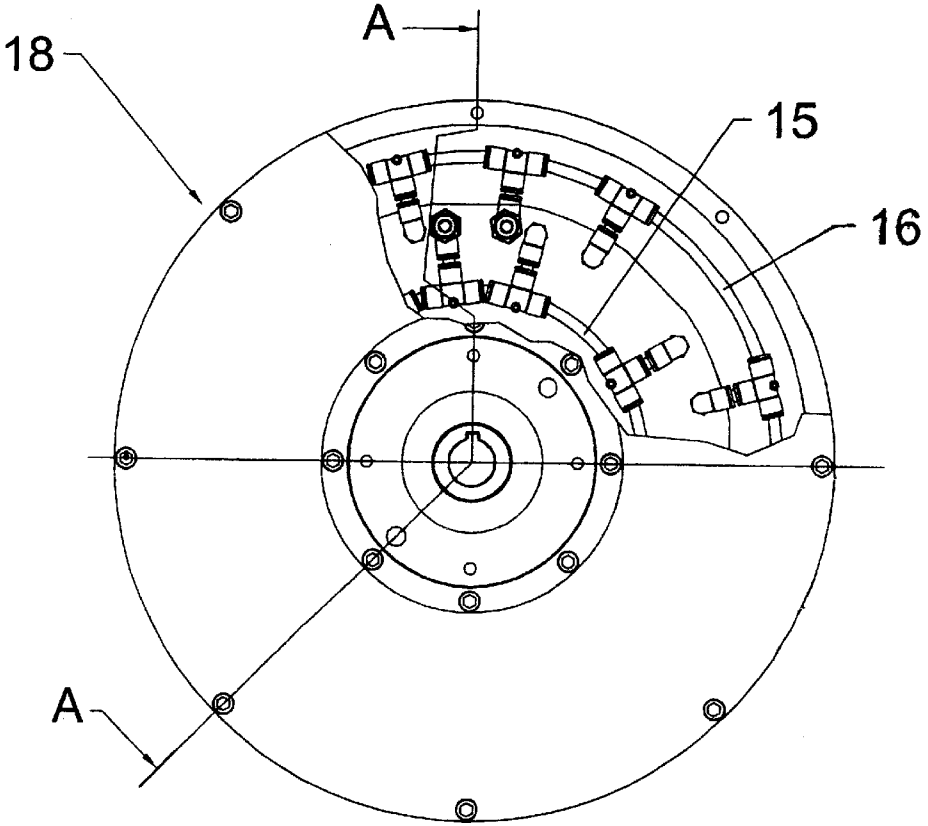

FIG. 11*a* shows an ideal torque profile for one piston; and

FIG. 11*b* shows the variables which can be altered to provide an improved drive cam profile.

Various embodiments of the invention are described below. It will be noted that, where appropriate, like reference numerals will be used for like elements to avoid repetition.

Referring to FIGS. 1 to 4 a fluid motor 18 includes a stator 11 of generally circular cross section and a rotor 3 mounted concentrically and centrally in the stator 11 on bearings 2. The stator 11 also includes a cylinder block 7 carrying, in the embodiment shown, eight pistons 13 extending radially in equi-angularly disposed cylinders. Each piston 13 reciprocates in the radial direction and has two bearing rings 5 and a seal ring 4 forming an airtight seal between the cylinder of the cylinder block 7 and the piston 13. Also located on the cylinder block 7 are eight mechanically operated valves, one for each piston, which, in the embodiment shown, comprise three-port, two-position valves 9. Each valve 9 controls an associated piston.

The rotor 3 includes a portion extending axially beyond the stator 7, 11 from which a concentric and generally circular support plate 10 extends. The support plate 10 further includes a concentric cylindrical support portion 10*a* extending axially inwardly generally at the periphery of the support plate 10. The cylindrical support portion 10*a* extends around at least a part of the stator, and in particular the cylinder block 7 and the assembly of valves 9. Mounted on the inside face of the cylindrical support portion 10*a* is a valve cam profile 6 arranged to cooperate with, and control operation of the valves 9. Also provided on the inside face of the cylindrical support portion 10*a* is a drive cam profile 8 arranged to cooperate with, and be driven by, the pistons 13. A cam follower bearing 14 is located at the outer end of each piston 13 to aid accurate following of the drive cam profile 8.

In the arrangement shown the drive cam profile 8 and valve cam profile 6 are spaced from one another in the axial direction with the valve cam profile 6 intermediate the support plate 10 and the drive cam profile 8. Of course any suitable disposition can be used as long as the cam profiles are suitably placed to cooperate with the respective piston and valve assemblies. Similarly the support plate 10 can be positioned elsewhere on the rotor as long as it acts to mount the cam profiles suitably positioned relative to the piston and valve assemblies.

The stator 11, cylinder block 7, cylinders for the pistons 13, and valves 9 are all fixed relative to one another and together form a stator assembly 24. The rotor 3, support plate 10, cylindrical support portion 10*a*, valve cam profile 6 and drive cam profile 8 are all mounted fixedly relative to one another to form a rotor assembly 26 which is rotatably mounted relative to the stator assembly.

Further mounted on the stator assembly 24 is a fluid supply line 15 and a fluid exhaust line 16, for example in the form of concentric ring mains. The supply and exhaust lines 15, 16 communicate with the external environment via one or more fittings 1. The fluid is supplied to drive the pistons 13, and is exhausted from the piston cylinders as described in more detail below under the control of valves 9 cooperating with the supply and exhaust lines 15,16.

The various elements of the motor can be made of standard materials, as will be apparent to the skilled person, and the valves 9 can be conventional three-way, two-position valves of suitable known type. The dimensions of the motor are dependent on the application, but the drive cam profile amplitude is determined to ensure that the cam follower bearing never adopts a pressure angle greater than 45° or more—the 45° angle giving maximum torque; accordingly the amplitude is calculated based on the desired maximum pressure angle, the number of lobes and (in the case shown in FIG. 1) the maximum diameter of the drive cam profile.

Figure 3:
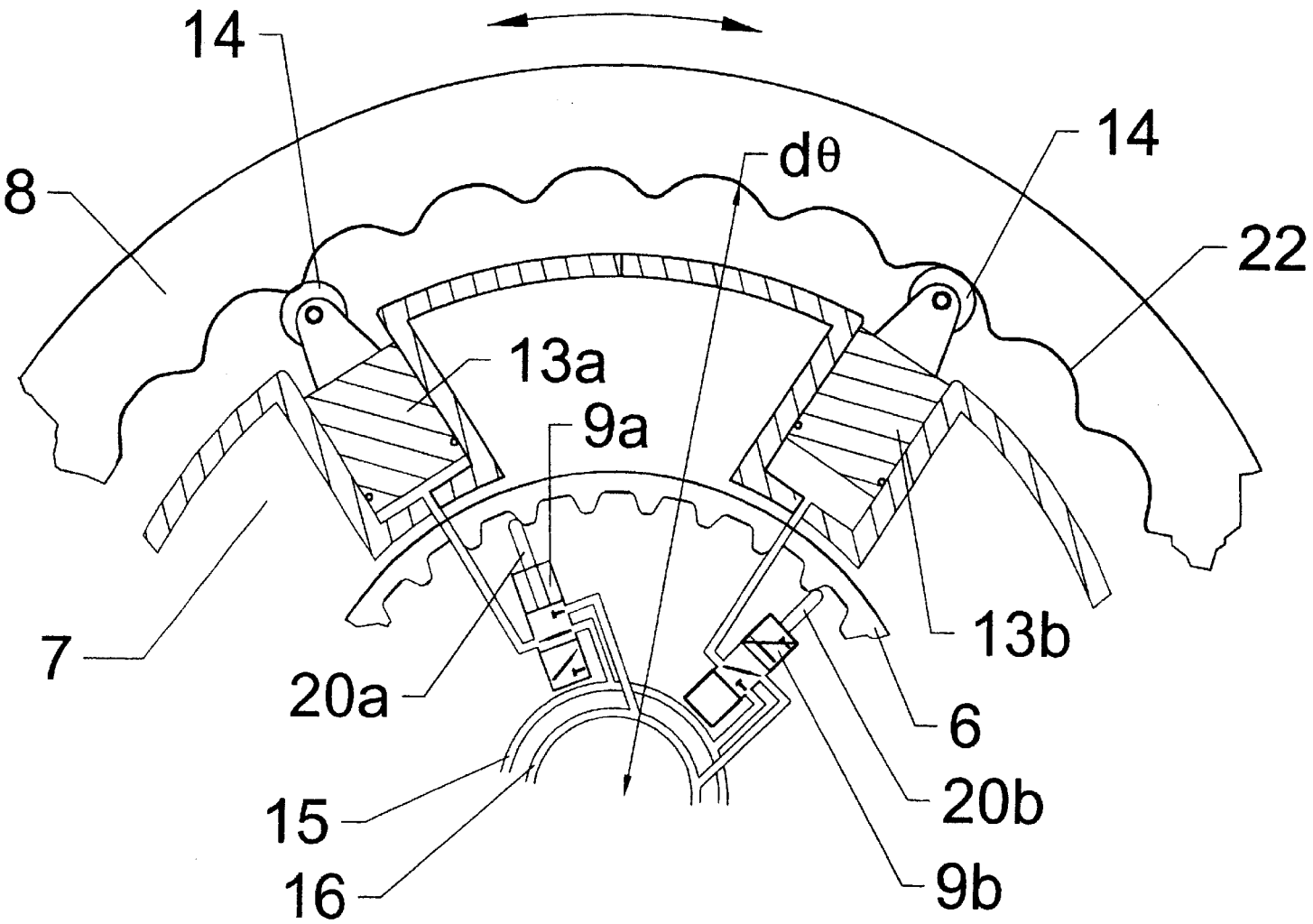
FIG. 3 is a partial, cut-away view showing a detail of the fluid motor of FIGS. 1 and 2.
Figure 4:
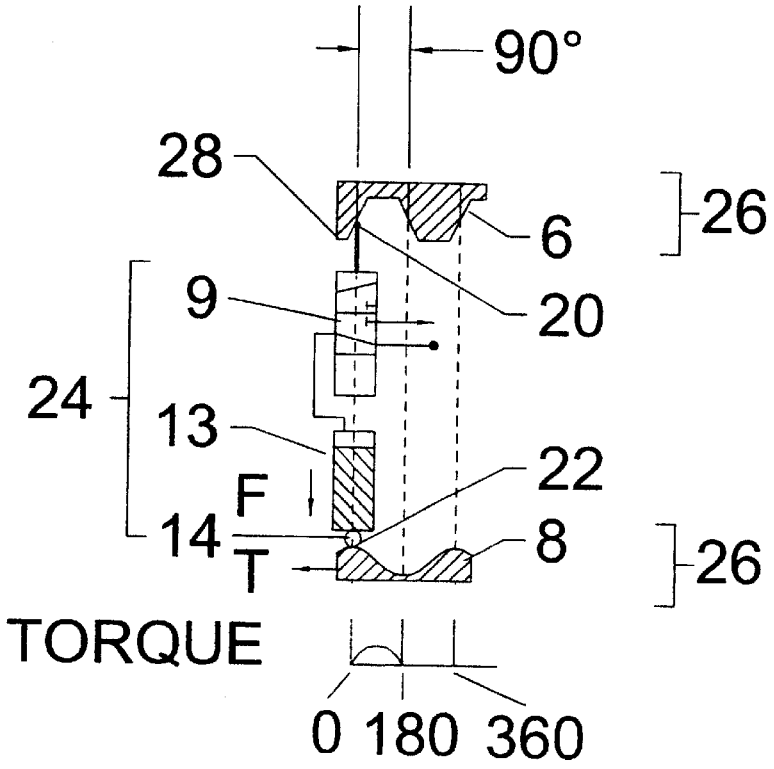
FIG. 4 shows schematically the phase relationship between the drive cam profile and valve cam profile in FIGS. 1 to 3.

FIGS. 3 and 4 demonstrate operation of the motor. The basic principle of operation is that the pistons 13 (represented in FIG. 3 by pistons 13*a*, 13*b*) are driven in a predetermined sequence outwardly, in the radial direction, by the pressurised fluid. The cam follower bearing 14 which, in the embodiment shown, comprises a wheel at the outward end of the piston, forces the rotor assembly to rotate by traversing along and driving the drive cam profile 8 as the piston is on its outward stroke. As one piston completes its drive stroke another piston will be commencing its drive stroke. The sequence followed by the pistons is governed by the valves 9 (represented in FIG. 3 by valves 9*a*, 9*b*). The valves 9 are each controlled by a radially reciprocating plunger 20 which cooperates with and is driven by the valve cam assembly 6. Because the valve cam profile 6 and drive cam profile 8 are in fixed relation to one another on the cam assembly the phase relationship between driving of the pistons and operation of the valves is also fixed such that, in operation, actuation of the pistons drives the drive cam profile 8 which in turn actuates the valves 9, controlling operation of the pistons 13 allowing continuous linked control. For example as shown in FIG. 4 the valve cam lobe 28 associated with a given piston 13 leads the drive cam lobe 22 traversed by the corresponding piston by 90°. The angle selected is of course dependent on, for example, the physical location of the pistons and valves.

As pressurised fluid is allowed into each cylinder by the respective valve the piston 13 is driven outwardly to advance the rotor. As the supply of pressurised fluid is cut off to each piston 13 and the exhaust line 16 opened, the piston 13 will be driven radially inwardly by the drive cam profile 8 (which is being driven by an adjacent piston) to exhaust the drive fluid via the exhaust line 16.

The driving force is provided by pressurised fluid fed through fitting 1 which in turn feeds main ring 15 connected to a supply port of each valve 9*a*, 9*b*. When a first piston 13*a* is at bottom dead centre of its stroke and the cylinder in cylinder block 7 is at minimum volume the valve cam 6 begins driving the valve plunger 20 downwardly to open the valve 9*a* corresponding to the piston 13*a* such that fluid is supplied from supply line 15 to drive the piston 13*a* outwardly. At the same time the adjacent piston 13*b* has reached top dead centre and is beginning its downward stroke, and the valve cam assembly cooperates with valve plunger 20*b* to close off supply from the supply line 15 and open the exhaust port allowing drive fluid to exhaust via exhaust line 16. Operation of the motor 18 continues in this manner with adjacent pistons 13*a*, 13*b* reciprocating in opposite directions.

Preferably the pistons 13 are provided in diametrically opposed pairs and with synchronised drive strokes, balancing the radial forces on the drive cam profile 8. In this case the number of valves can be halved, with one valve controlling each synchronised pair of pistons.

It will be seen that the embodiment shown has various advantages. In particular the provision of a drive cam profile 8 outside the stator assembly 24 allows a significant increase in the circumference of the profile. As a result the number of lobes 22 on the profile 8 is significantly increased. This in turn means that variations in the output torque are greatly reduced as a single piston stroke contributes to only a small portion of a full rotation of the drive cam profile 8 and hence the rotor assembly 26. Furthermore, as discussed above, the pistons 13 are preferably provided diametrically opposed to one another and synchronised such that radial forces on the rotor assembly 26 are balanced. Yet furthermore the valve 9 and piston 13 actuation are mechanically synchronised, at the same time not prejudicing the construction of the pistons 13 themselves in any way. Yet further, the symmetrical construction of the motor 11 means that reversing the flow of fluid through the motor (i.e. switching the supply and exhaust lines) will reverse the motor. A further advantage is that if an appropriate load is attached to the rotor assembly 26 then the motor 11 will stall indefinitely with full supply pressure, without damage and whilst maintaining constant torque. Yet further, because of the large number of pistons 13 provided, where the driving fluid is compressed air the compressibility of that compressed air is geared out such that the operation of the motor 11 approximates to that of a hydraulic motor. The compressibility of the compressed air can otherwise affect operation of the motor because of the "springiness" of common pneumatic cylinders. In particular this is achieved because each of the many pistons 13 requires a comparatively small quantity of air, hence reducing the compressibility for each cylinder. It will be noted that the motor is further able to operate using any of a variety of fluids including air, for example dry air, wet air or lubricated air, or a hydraulic fluid such as oil.

It will be appreciated that the relative number of drive cam profile lobes 22 and pistons 13 can be varied as appropriate. For example referring to the following table, the number of pistons 13, angle between pistons, number of drive cam lobes 22 and angle between drive cam lobes is shown:

| No Pistons | Angle between Pistons | No of Cam lobes | Angle between Cam lobes |
|---|---|---|---|
| 4 | 90 | 3 | 120 |
| 4 | 90 | 6 | 60 |
| 8 | 45 | 6 | 60 |
| 8 | 45 | 3 | 120 |
| 6 | 60 | 8 | 45 |

It will be appreciated that the table is illustrative and does not of course cover all possible configurations. In particular the design can be expanded in multiples of four pistons 13 and multiples of seven drive cam lobes 22, or alternatively in multiples of six pistons and multiples of seven cam lobes. The case of 8 pistons can be viewed as corresponding to the combination of two 4 piston motors and so forth. The number of drive cam lobes is variable as long as the pistons will achieve their desired stroke position at any time—for example 8 pistons and 34 lobes would be possible.

In addition the number of valve cam lobes 28 relative to the number of drive cam lobes 22 and/or pistons 13 can be varied as appropriate.

Figure 5:
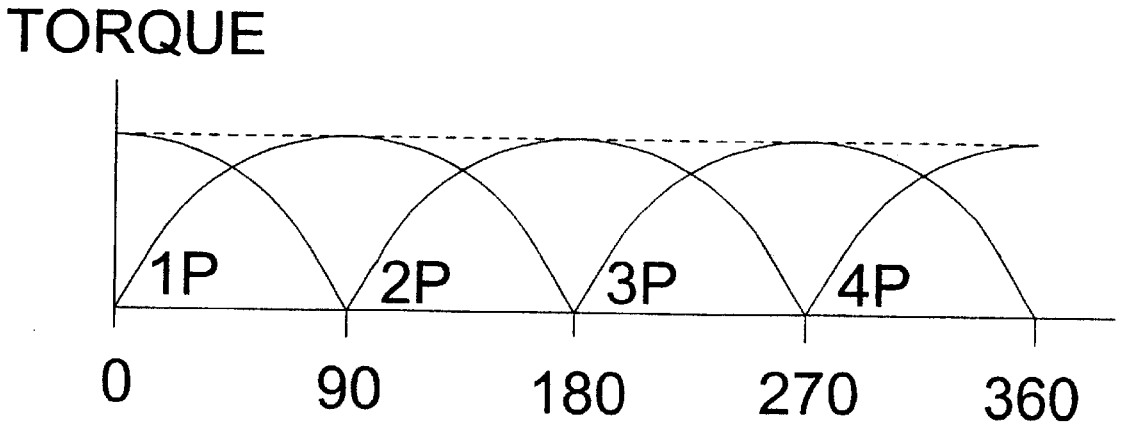
FIG. 5 is an illustration of superimposed force stroke torque output profiles for a plurality of pistons out of phase with one another.

In a particularly preferred embodiment the motor is configured to achieve substantially constant torque. This is achieved by shaping the drive cam profile 8 appropriately. It will be recognised that the output torque profile over time is the sum of the individual torque profiles provided by each piston over time. As illustrated in FIG. 5, a substantially constant torque output profile TORQUE can be achieved by superimposing four individual torque output profiles 1P to 4P each comprising the positive half (180°) of a sinusoidal curve, and each 90° out of phase, where a full cycle of 360° corresponds to a single piston 13 going through a full drive and return stroke. It will be appreciated that the system is cyclical and hence the substantially constant torque output profile will be maintained as each piston 13 continues through its drive and return stroke.

FIG. 5 shows how the individual profiles can be achieved with linear motion in which the cam has a linear axis along which it moves/reciprocates and along which the drive cam profile is provided. In this case if the cam profile is sinusoidal then the individual output force profiles afforded by each piston will also be sinusoidal giving rise to a output force profile which is substantially constant.

Figure 1:
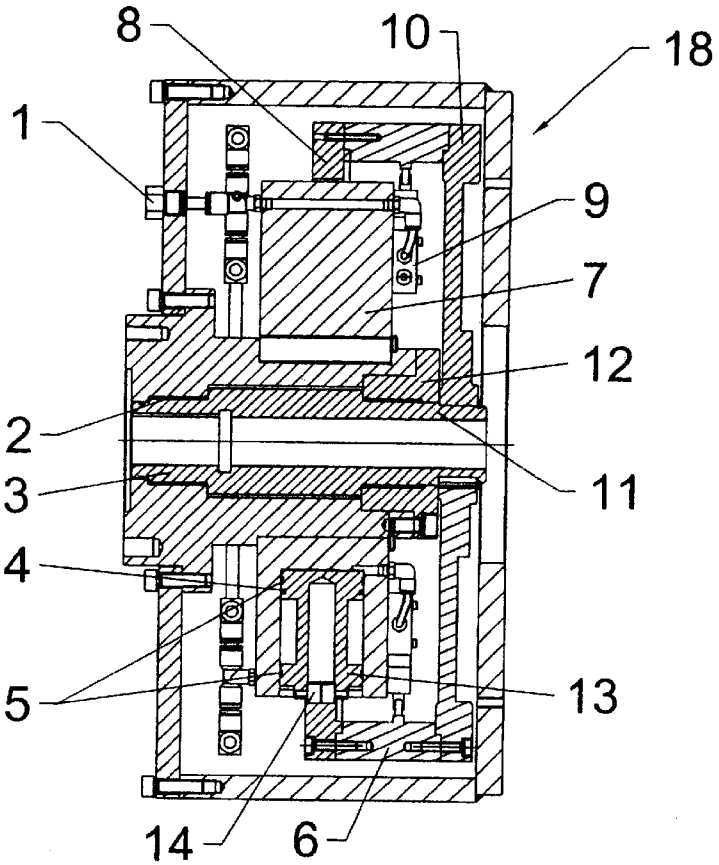
FIG. 1 is a sectional view of a fluid motor according to the present invention.

In order to apply this system to a rotational system it is simply necessary to map the simple sinusoidal profile for the linear arrangement onto a circular cam profile of the type shown in FIG. 1. This is a straightforward mathematical operation that will be known to the skilled person, but for completeness the sinusoidal profile expressed in Cartesian (x,y) coordinates is mapped or transformed to (r,θ), polar geometry.

It will be recognised that the linear system shown in FIG. 5 is an idealisation for another reason, namely that the piston is assumed to contact the cam profile at a single point along the central axis of the piston. Of course in practice some sort of bearing is highly desirable such as the wheel bearings 14 shown in FIG. 3. As a result the "point of contact" model shown in FIG. 5 is only an approximation. Existing mathematical methods which will be familiar to the skilled person may further be used to shape the cam profile to take into account the non-ideal piston bearing contact. Furthermore, numerical/iterative methods of known type can be used—for example in computer or mathematical modelling—to achieve a yet further improved cam profile to obtain additional improvements in torque smoothness.

For example, referring to FIG. 11*a*, where:

$T_\theta$=Torqu generated over one piston cycle;

$T_{MAX}$=Maximum torque required;

$$T_\theta = T_{MAX} \cdot \sin(\theta) + 0 \quad (1)$$

Bearing in mind the equation for torque, where:

T=Torque;

F=Force applied at a tangent;

d=Distance from centre $$T = F.d, \quad (2)$$

combining (1) and (2), and referring to FIG. 11*b* which is a graph of angle (θ) against distance (in m) from the radial centre of the cam profile, we can arrive at a function determining the preferred cam profile:

$$T_\theta = F_{\mathrm{MAX}} \cdot \cos \frac{\Delta_{y\theta}}{\Delta_{x\theta}} \cdot d_\theta \quad (3)$$

Where:

$F_{MAX}$=constant force over piston power stroke;

$d_\theta$=distance from centre of drive cam to cam profile as shown in FIG. 3

$\Delta_{y\theta}$, $\Delta_{x\theta}$ and $d_\theta$ vary as a function of θ;

Expressed in words, the force exerted by the piston is constant over the drive stroke as it derives from the fluid entering the cylinder. The torque exerted by the piston is a function of the force, the slope of the cam profile at the point of contact and the distance between the point of contact and the centre of the cam profile (the cam profile surrounds the stator as in FIG. 3 in the arrangement shown in FIG. 11).

Accordingly equation (3) is solved by numerical or iterative methods known to the skilled person for:

$$\frac{\Delta_{y\theta}}{\Delta_{x\theta}} \text{ and } d_\theta,$$

to obtain the desired $T_\theta$ as shown in equation (1).

It will be recognised that the embodiment described in detail above is merely one application of the invention. For example, as discussed in more detail above, the number of pistons and drive cam lobes can be varied to achieve various different relationships. In addition the number of valve cam lobes can be varied.

Figure 6:
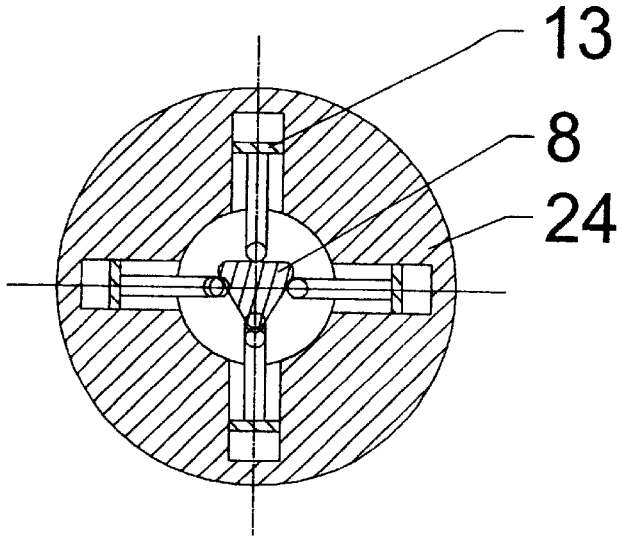
FIG. 6 is a schematic sectional view of an alternative embodiment in which the drive cam profile is provided at the centre of a stator carrying pistons.

Referring to FIG. 6 the pistons 13 can be disposed around the drive cam profile 8 rather than vice versa. In that case the valve cam profile (not shown) can also be provided inside the pistons 13 or can alternatively extend outside those pistons as shown in FIG. 1.

Figure 7:
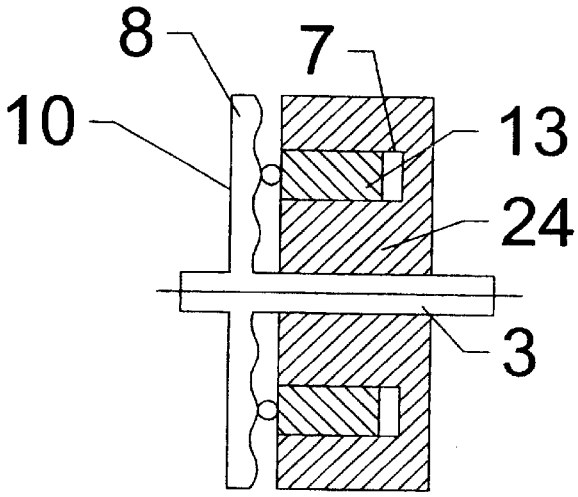
FIG. 7 shows a further alternative embodiment in which the drive cam profile is provided at an axial end of the stator and cooperates with axially reciprocating pistons.

In a further alternative embodiment shown in FIG. 7 the drive cam profile 8 is mounted inside and concentrically to the stator assembly 24, but a support plate 10 of generally circular shape mounted on the rotor 3 includes a drive cam profile 8 on its circular surface facing the stator assembly 24 in the axial direction. Pistons 13 are mounted to reciprocate in the axial direction in the cylinder block 7. The drive cam profile 8 on the support plate 10 is shaped such that as the pistons reciprocate the rotor 3 is driven to rotate. Once again the valve cam profile is generally sinusoidal and can be provided in a similar manner to that shown in FIG. 1 or in any other appropriate manner.

Figure 8:
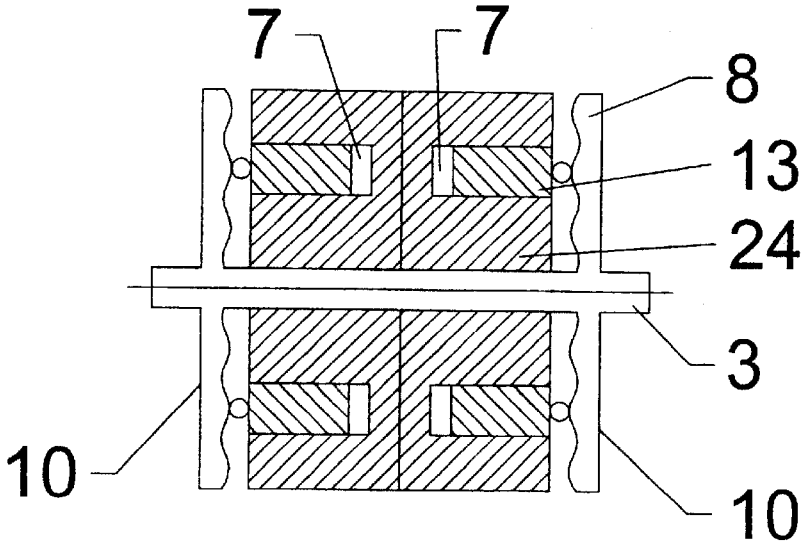
FIG. 8 shows a variant of the arrangement shown in FIG. 7 in which drive cam profiles are provided at each axial end of the stator.

In a variation on the arrangement of FIG. 7 shown in FIG. 8 the rotor 3 has support plates 10 mounted at both ends with drive cam profiles on their surfaces facing one another. The stator assembly 24 include pistons 13 mounted to reciprocate axially and extending from opposed faces of the cylinder block 7. As a result the drive cam profiles 8 on each of the support plates 10 are driven at the same time. Yet again the valve cam profile can be provided in any appropriate manner. It will be recognised that this arrangement affords particular advantages because of its axial and radial symmetry allowing both axial and radial forces to be balanced out in operation.

Figure 9:
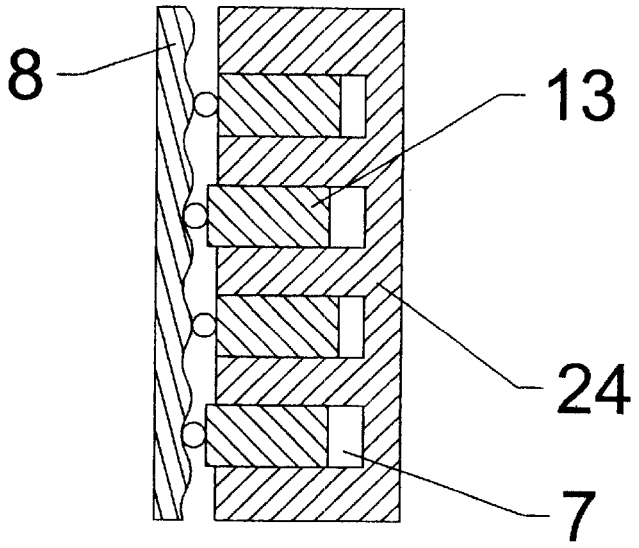
FIG. 9 shows a further alternative embodiment of the invention in which the drive cam profile is arranged for linear motion relative to the stator assembly.

In yet a further alternative embodiment shown in FIG. 9 the motor is arranged for linear motion. In particular the cylinder block 7 includes a plurality of pistons 13 arranged to cooperate with a linear drive cam profile 8 by appropriate sequential actuation. Once again the valve cam profile operates in the same way as for the rotary arrangements, being of the same pitch as the drive cam profile.

It will be seen that other variables can be altered to improve or control operation of the motor. For example double-acting pistons which drive on the stroke in either direction can be used. In addition the power stroke phase can be varied appropriately and set, for example, at 60° rather than 90° apart. As more sinusoidal power strokes are provided overlapping the constant torque output will continue and the amplitude will increase correspondingly.

Figure 10:
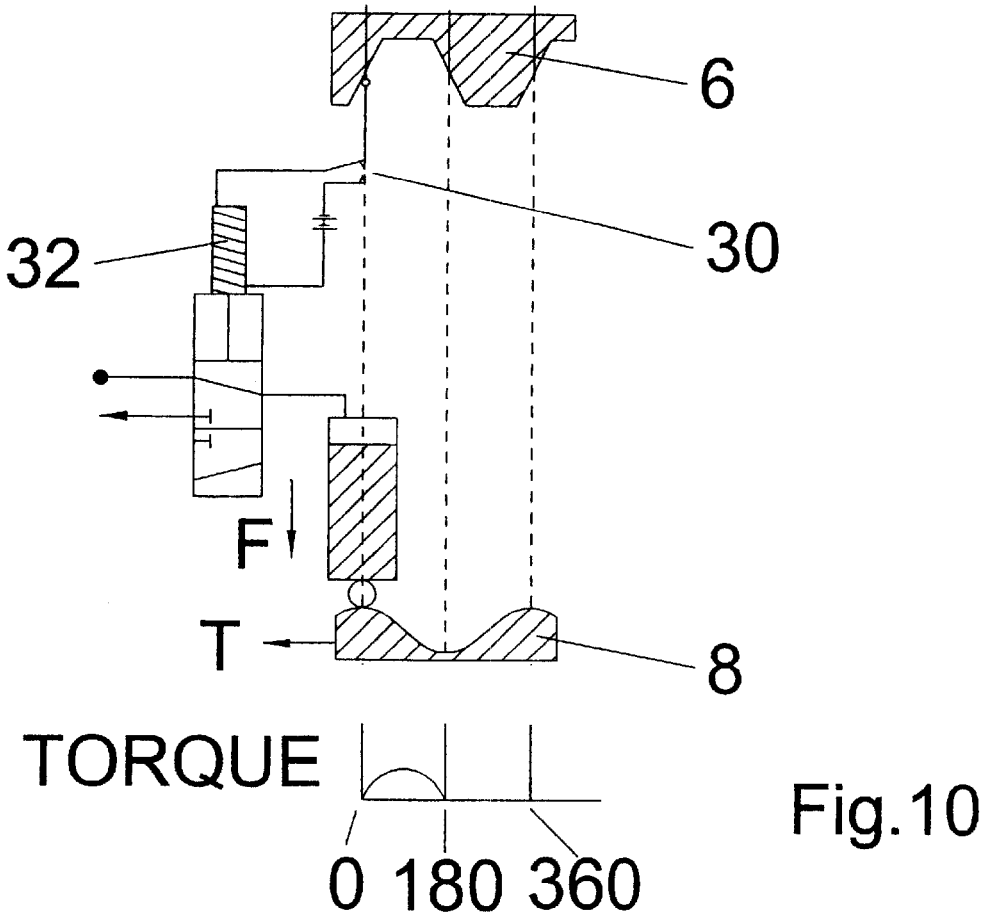
FIG. 10 shows an alternative embodiment of the invention in which the valves are actuated in a manner other than by a mechanical linkage with the valve cam profile.

In a further embodiment the actuation of the valves 9 can be achieved in various manners as shown in FIG. 10. For example instead of a direct mechanical linkage between the valve cam profile 6 and the valve plungers 20, the valve cam profile 6 can actuate an intermediate electronic switch means 30 of any suitable type which switch the valves 9 electronically for example using a solenoid valve 32. Alternatively the valve cam profile 6 can be removed entirely and electronically driven valves 9 can be provided in conjunction with each piston 13. In this case control of the valves 9 is achieved purely electronically, for example based on sensing the position of the drive cam profile 8 or following a pre-programmed sequence, although in this case it will be preferable to maintain a feedback signal from the motor 11. In this manner operation approximating that of an electric stepper motor can be achieved. Although discussion has been made of driving the pistons 13 successively it should be recognised that this may not necessarily be limited to driving adjacent pistons sequentially but can simply relate to driving the pistons in a predetermined sequence; this is particularly suited to electronic control although the valve cam profile could be shaped in a manner to achieve this as will be apparent to the skilled person.

Numerous applications for the motor are available. For example the rotary motion achieved by the motor can be used in a vehicle traction drive by coupling the rotational motion of the rotor to the vehicle drive in any suitable manner. Many other applications can be contemplated. For example the motor can be used in robotic positioning drives, conveyor drives, mechanical handling drives, machine tool drives, transmission drives, active brakes (for example by "stalling" the motor), pneumatic servo motor drives, modulating motor drives, retarders and accelerator boosters.

One preferred use is in relation to valve actuation, for example for rotationally operated valves such as a quarter turn ball valve, a gate valve, a multi-turn choke valve, a multi-position ball valve, a flow control valve, a butterfly valve, a flapper check valve, a needle valve or a cone valve. For example the quarter turn ball valve is a device for the positive shut-off of fluids in pipelines. It consists of a polished sphere housed within a pressure retaining housing and on the centreline of the pipeline. The sphere is bored through such that the continuity of the pipeline internal diameter is maintained. Stub shafts fixed to the sphere (ball) allow the ball to rotate such that the bore is blocked, effectively closing the valve. This takes one quarter of a turn to accomplish.

A derivative of this valve is a PIG (pipeline internal gauge) insertion valve which differs by the sphere bore being cranked at 90°. This allows a PIG to be inserted into the valve bore whilst the blanked portion of the sphere seals off the pipeline. One quarter turn of the valve then enables the PIG to be pressure launched out of the valve and into the pipeline.

The actuator is attached to one of the stub shafts, which is in turn allowed to penetrate the pressure housing, facilitated by rotating seals. Rotation is accomplished by any of the following means:

directly with the motor shaft by way of a coupling;

indirectly through a torque multiplication device such as a gear train, sprocket and chain, worm and wheel or toothed belt;

indirectly through a crank.

Alternatively the multi position ball valve is a device for changing the flow direction of single or multiple pipelines. The ball is bored in a similar way to that of the PIG insertion valve, but in this instance the valve pressure housing has multiple entries and exits. By rotating the valve through discrete 90° steps throughout its entire 360° capability, the flow in pipelines can be diverted.

The actuator is attached in an identical manner to that of the quarter turn ball valve but in this instance the actuation is allowed throughout the 360° of rotation.

Alternatively the gate valve is a device for the positive shut-off of fluids in pipelines. It consists of a polished rectangular slab, of metal (gate) housed within a pressure retaining housing and on the centreline of the pipeline. The gate is bored through such that the continuity of the pipeline internal diameter is maintained. At one end of the gate, a cylindrical rod or stem is allowed to penetrate the pressure housing, facilitated by rotating or sliding seals. Linear movement of the valve gate, either push-pull or rotational, effectively blocks the pipeline bore to create a seal. The valve gate can vary in design being parallel or wedge shaped or being split or mono-slab.

The actuator is attached to the valve gate stem, and being a rotational device translates rotational motion into linear motion by way of a screw thread or a ball screw. The design of the valve actuator dictates the mode of operation of the valve to give the following operational characteristics:

open/close; where application of actuator pressure either opens or closes the valve;

failsafe close; where sustained actuator pressure maintains the valve in its open (or closed) position, loss of which will allow the valve to return to its fail safe closed (or open) position.

Alternatively the choke valve is a device for reducing the pressure of fluids in pipelines. It consists of a plunger within a cylindrical sleeve which has a series of holes located along its length. Linear travel of the plunger sequentially blanks-off more of the sleeve holes to the pipeline upstream fluids, thereby dissipating energy and reducing the downstream pressure. Variations of the valve include:

fixed plunger, moving sleeve;

fixed sleeve, moving plunger;

rotating discs.

The actuator is attached in an identical manner to that of the gate valve but in this instance accurate actuator positional control enables the valve moving plunger (or sleeve/disc) to be positioned at any point thereby selecting the precise downstream pressure required. Furthermore, the actuator may be linked to a servo or microprocessor control device to enable the valve to modulate its position, thereby maintaining a constant downstream pressure from a fluctuating upstream pressure.

Alternatively the flow control valve is a device for varying the flowrates of fluids in pipelines. It is a device similar in construction to a ball valve but with a series of holes located in the sphere wall. By rotating the position of the valve, more holes are revealed to the upstream fluid flow thereby allowing a greater flow. Conversely, by closing the valve, reducing the number of flow-by holes, the flow is restricted. As with the choke valve, stabilised downstream flow can be achieved by modulating the valve against a fluctuating upstream flow, utilising a servo or microprocessor control device.

The actuator is attached in an identical manner to that of the ball valve application.

Alternatively the butterfly valve is a device for the positive shut-off of low pressure fluids in pipelines. It consists of a disc housed within a low pressure housing and placed perpendicular to the centreline of the pipeline. The disc is located on a rotating shaft which is perpendicular to the pipeline centreline and penetrates the pressure housing facilitated by rotating seals. One quarter rotation of the butterfly shaft positions the butterfly disc along the direction of flow, un-blocking the pipeline to allow free-flow. The actuator is attached in an identical manner to that of the ball valve application.

Alternatively the flapper check valve is a device to automatically prevent the reverse flow of fluids within a pipeline. It is similar in construction to a butterfly valve but differs in that there is no central operating shaft. The flow shut-off disc is attached to a lever arm which is hinged to form a flap. In one direction of flow, the fluid simply pushes past the flap by hinging it upwards out of the flow stream. When flow ceases, gravity allows the flapper to fall and close off the valve. If the flow stream pressure reverses, the flapper forms a high pressure seal as the fluid acts upon the disc area. These valves usually operate without the need for actuators. However, in certain applications, the valve is required to be artificially held open to allow back-flow, or the passage of mechanical PIG's. In this instance the flapper leaver hinge shaft penetrates the pressure housing facilitated by rotating seals whereby an actuator is attached.

The actuator is attached in an identical manner to that of the ball valve application but in this instance the actuator must allow free rotation of the shaft throughout normal operation and only exert influence when activated.

Alternatively the needle valve is a device for positive, gas tight metal-to-metal sealing of fluids in pipelines. The plunger is shaped into a conical point (needle) which locates and seals against a circular seal face. Its mode of operation is identical to that of the gate valve. A variation of the needle valve is to specifically shape the needle to provide gradual shut-off such that the flow can be varied as actuation progresses. In this instance the actuation is identical to that of the choke valve.

Alternatively the cone valve is a derivative of the ball valve but in this instance the ball is replaced by a cone shaped plug sealing inside a cone shaped sleeve. Actuation is by one quarter turn.

It will be recognised that the teachings and features of any one embodiment described above may be incorporated in any of the other embodiments as appropriate. In particular the preferred cam profile can be adapted using basic mathematical techniques available to the skilled person applied to any of the various motor configurations described above. In addition the number of pistons, the relationship of piston number to drive cam lobe number, the angular displacement between pistons, the angular displacement between drive cam lobes and the relationships between all of these variables can be varied as appropriate. Yet further the relationship between the valve cam, the drive cam and the pistons can be altered as appropriate, for example to select the offset between driving of the drive cam and actuation of the valves by introducing a phase offset (in the time domain) between the drive cam and the valve cam of any suitable magnitude.

What is claimed is:

1. A fluid motor comprising a stator part and an advanceable part advanceable relative to the stator part, in which one of said parts includes a drive cam profile and the other part includes one or more fluid actuated advancing elements arranged to traverse the drive cam profile to advance the advanceable part relative to the stator part, in which the drive cam profile is substantially sinusoidal, in which at least one actuable valve is provided to control fluid actuation of the one or more fluid actuated advancing elements, in which a valve cam profile is provided fixed relative to the drive cam profile, and in which the valve cam profile cooperates with the at least one actuable valve to control actuation of the at least one actuable valve.

2. A fluid motor as claimed in claim 1 in which a plurality of advancing elements are provided, each arranged to advance the advancing part during an advancing stroke, at least some of the advancing strokes overlapping temporally.

3. A fluid motor as claimed in claim 1 in which the parts are rotationally advancable relative to one another and the drive cam profile comprises a linear substantially sinusoidal profile mapped onto a circular geometry.

4. A fluid motor as claimed in claim 3 in which the one or more fluid actuated advancing elements are mounted to oscillate on the stator part and the advancable part comprises a rotor part.

5. A fluid motor as claimed in claim 4 in which the one or more fluid actuated advancing elements are provided in synchronized, opposed pairs on the stator part.

6. A fluid motor as claimed in claim 4 in which the drive cam profile is on the rotor part and is disposed radially outside the stator part, and the one or more fluid actuated advancing elements oscillate in a radial direction.

7. A fluid motor as claimed in claim 4 in which the drive cam profile is on the rotor part and is disposed radially inside the stator part, and the one or more fluid actuated advancing elements oscillate in a radial direction.

8. A fluid motor as claimed in claim 1 in which the stator part and advancable part are symmetrically arranged allowing the fluid motor to be stalled and/or operated in reverse.

9. A fluid motor as claimed in claim 1 in which the one or more fluid actuated advancing elements comprise double acting pistons.

10. A fluid motor comprising a stator part and an advanceable part advanceable relative to the stator part, in which one of said parts includes a drive cam profile and the other part includes one or more fluid actuated advancing elements arranged to traverse the drive cam profile to advance the advanceable part relative to the stator part, in which the drive cam profile is substantially sinusoidal;

wherein the parts are rotationally advancable relative to one another and the drive cam profile comprises a linear substantially sinusoidal profile mapped onto a circular geometry;

wherein the one or more fluid actuated advancing elements are mounted to oscillate on the stator part and the advancable part comprises a rotor part; and in which the drive cam profile is on the rotor part and is disposed axially outside the stator part, and the one or more fluid actuated advancing elements oscillate in an axial direction.

11. A fluid motor as claimed in claim 10 in which at least one actuable valve is provided to control fluid actuation of the one or more fluid actuated advancing elements, electronic control means being provided to control actuation of the at least one actuable valve.

12. A fluid motor comprising a stator part and an advanceable part advanceable relative to the stator part, in which one of said parts includes a drive cam profile and the other part includes one or more fluid actuated advancing elements arranged to, traverse the drive cam profile to advance the advanceable part relative to the stator part, in which the drive cam profile is substantially sinusoidal, in which the parts are linearly advancable relative to one another and the one or more fluid actuated advancing elements oscillate in a direction transverse to a linear advancing direction.

13. A fluid motor comprising a stator part and an advancable part advancable relative to the stator part, in which one of said parts includes a drive cam profile and the other part includes one or more fluid actuated advancing elements arranged to traverse the drive cam profile to advance the advancable part relative to the stator part, in which one or more valves is provided to control fluid actuation of the one or more fluid actuated advancing elements, in which a valve cam profile is provided fixed relative to the drive cam profile, and in which the valve cam profile cooperates with the one or more valves to control actuation of the one or more valves.

14. A fluid motor as claimed in claim 13 in which the one or more valves include a cam follower valve actuation controller mechanically linked to the one or more valves and arranged to follow the valve cam profile to control actuation of the one or more valves.

15. A fluid motor as claimed in claim 13 in which a valve cam profile follower is arranged to generate a control signal representative of its position on the valve cam profile and the one or more valves are electronically actuated dependent on the control signal.

16. A fluid motor comprising a stator and a rotor in which the rotor includes a drive cam profile and the stator includes a fluid actuated advancing element arranged to oscillate in a radial direction to traverse the drive cam profile to advance the rotor relative to the stator, in which the drive cam profile of the rotor is disposed radially outside the stator, including a rotor shaft around which the stator is provided, a drive cam profile support extending from the shaft and a valve cam profile provided on the drive cam profile support spaced from the drive cam profile in which at least one actuable valve is provided to control fluid actuation of the advancing element and in which the valve cam profile cooperates with the at least one actuable valve to control actuation of the at least one actuable valve.

17. A fluid motor comprising a stator part and an advancable part advancable relative to the stator part, in which one of said parts includes a drive cam profile and the other part includes fluid actuated advancing elements arranged to traverse the drive cam profile to advance the advancable part relative to the stator part, in which the drive cam profile is substantially sinusoidal, and in which an individual actuable valve is provided to control actuation of each one of said advancing elements, in which electronic control means are provided to control actuation of the valves.

* * * * *

UNITED STATES PATENT AND TRADEMARK OFFICE

CERTIFICATE OF CORRECTION

PATENT NO. : 6,575,078 B1
DATED : June 10, 2003
INVENTOR(S) : Lyndon J. Wright et al.

It is certified that error appears in the above-identified patent and that said Letters Patent is hereby corrected as shown below:

Column 3,
Line 23, “section AA” should be -- section A-A --.

Column 7,
Line 13, “Torqu” should be -- Torque --.

Column 10,
Line 54, “PIG’s” should be -- PIGs --.
Line 55, “leaver” should be -- lever --.

Column 11,
Lines 24, 25, 29, 66 and 67, “advanceable” should be -- advancable --.

Column 12,
Lines 4, 22, 23 and 27, “advanceable” should be -- advancable --.

Signed and Sealed this

Sixth Day of January, 2004

JAMES E. ROGAN
*Director of the United States Patent and Trademark Office*